US008397941B1

(12) United States Patent
Stocker

(10) Patent No.: US 8,397,941 B1
(45) Date of Patent: Mar. 19, 2013

(54) DESSERT CUP HOLDER

(76) Inventor: Earl G. Stocker, Hudson, FL (US)

( * ) Notice: Subject to any disclaimer, the term of this patent is extended or adjusted under 35 U.S.C. 154(b) by 32 days.

(21) Appl. No.: 12/927,876

(22) Filed: Nov. 29, 2010

(51) Int. Cl.
*B65D 25/00* (2006.01)

(52) U.S. Cl. ..... 220/737; 220/738; 248/312.1

(58) Field of Classification Search ..... 215/395, 215/399; 220/630, 737, 736, 742, 738; 248/312.1; D9/455
See application file for complete search history.

(56) References Cited

U.S. PATENT DOCUMENTS

| | | | | | |
|---|---|---|---|---|---|
| 630,734 | A * | 8/1899 | Oothout | 248/154 |
| 1,021,328 | A * | 3/1912 | Noll | 248/312 |
| 2,150,784 | A * | 3/1939 | Roehm | 206/565 |
| 2,402,175 | A * | 6/1946 | Mapes | 248/154 |
| 2,665,936 | A * | 1/1954 | Moore | 294/33 |
| 4,198,020 | A * | 4/1980 | Walker et al. | 248/154 |
| 4,726,553 | A * | 2/1988 | Wischusen, III | 248/146 |
| 5,222,534 | A * | 6/1993 | Wilkinson, Jr. | 141/88 |
| 5,405,116 | A * | 4/1995 | Shepherd et al. | 248/312.1 |
| 5,533,700 | A * | 7/1996 | Porter | 248/311.2 |
| 5,996,507 | A * | 12/1999 | Joseph | 108/46 |
| 6,040,514 | A * | 3/2000 | Liao | 84/421 |
| 7,159,735 | B2 * | 1/2007 | Morse | 220/529 |
| 2008/0190948 | A1 * | 8/2008 | Sayasithsena | 220/737 |

* cited by examiner

*Primary Examiner* — Anthony Stashick
*Assistant Examiner* — Brett Edwards

(57) ABSTRACT

A rigid support base has flat parallel top and bottom surfaces. The top and bottom surfaces are separated by a thickness. The support base has a plurality of holes. A plurality of rigid rods is provided. Each rod has a lower end. The lower end is received and retained within an associated hole. Each rod has a notch. Each notch includes an upper ledge. The upper ledge is provided parallel with the top surface of the support base. Each notch includes an angled lower ledge. The lower ledge depends from an associated upper ledge.

2 Claims, 2 Drawing Sheets

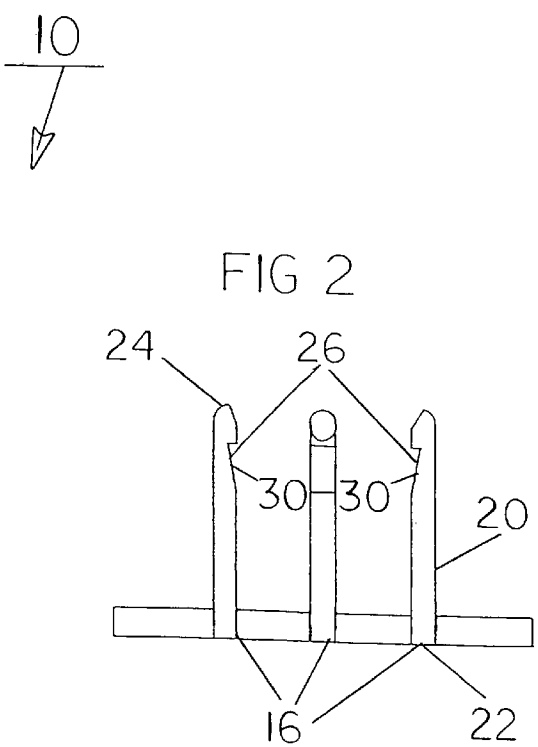
FIG 2
FIG 1
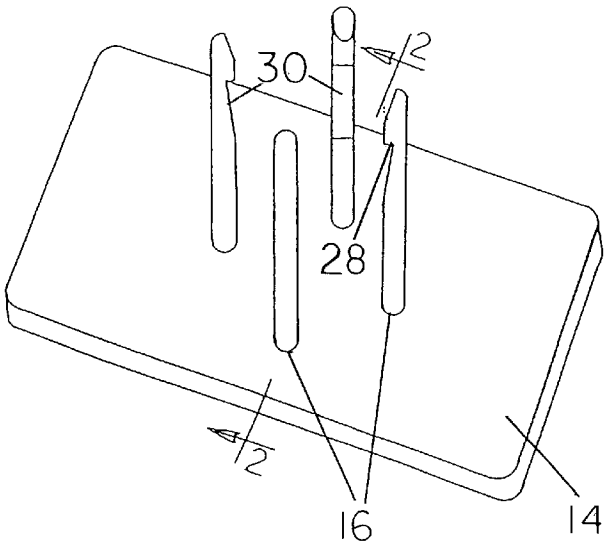

DESSERT CUP HOLDER

BACKGROUND OF THE INVENTION

Field of the Invention

The present invention relates to a dessert cup holder and more particularly pertains to releasably receiving and supporting a small dessert cup on a larger holder base to facilitate handling by those with reduced motor skills such as younger children, elderly senior citizens and physically handicapped people, the system being safe, convenient and economical.

SUMMARY OF THE INVENTION

In view of the foregoing disadvantages inherent in the known types of food holders of known designs and configurations now present in the prior art, the present invention provides an improved dessert cup holder. As such, the general purpose of the present invention, which will be described subsequently in greater detail, is to provide a new and improved dessert cup holder and method which has all the advantages of the prior art and none of the disadvantages.

To attain this, the present invention essentially comprises a dessert cup holder. First provided is a support base. The support base is provided in a rectangular configuration. The support base has parallel upper and lower edges. The upper and lower edges are separated by a height. The support base has parallel side edges. The side edges are separated by a width. The support base has flat parallel top and bottom surfaces. The top and bottom surfaces are separated by a thickness. The support base is fabricated of a rigid plastic material. Alternate materials for the support base include wood and metal. The support base has four cylindrical holes. The holes are in a rectangular configuration. The holes include two vertical holes. The vertical holes are aligned with the side edges. The vertical holes are equally spaced from the upper and lower edges. The vertical holes are equally spaced from the side edges. The holes include two horizontal holes. The horizontal holes are aligned with the upper and lower edges. The horizontal holes are equally spaced from the side edges. The horizontal holes are equally spaced from the upper and lower edges.

Four essentially cylindrical rods are provided. Each rod has a diameter. Each rod has a lower end. The lower end is received and retained frictionally and adhesively within an associated hole. Each rod has an upper end. The upper end is located above the top surface of the support base. Each of the rods are fabricated of a rigid plastic material. Alternate materials for the rods include wood and metal. Each rod has a notch. The notch of each rod faces the notch of a non-adjacent rod. Each notch includes an upper ledge. The upper ledge is parallel with the top surface of the support base. Each upper ledge is spaced from the top surface of the support base. Each upper ledge has a depth. Each notch includes an angled lower ledge. The lower ledge depends from an associated upper ledge. The lower ledge extends downwardly to a distance from the top surface of the support base.

Provided last is a dessert cup. The dessert cup has a closed circular bottom. The dessert cup has an open circular top. The dessert cup has a frusto-conical side wall. The bottom has a diameter. The top has a diameter. The dessert cup is fabricated of generally rigid material with limited flexibility. Alternate materials for the dessert cup include paper and foamed plastic. In this manner the desert cup is adapted to be moved between a supported orientation and an unsupported orientation. The unsupported orientation is with the cup separated from the support base. The supported orientation is with the bottom of the dessert cup positioned on the top surface of the support base. The top of the dessert cup is secured beneath and in contact with the upper ledges and laterally offset from the angled ledges of the rods. The dessert cup is movable between the supported orientation and the unsupported orientation through the flexing of the top of the dessert cup.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved dessert cup holder which has all of the advantages of the prior art food holders of known designs and configurations and none of the disadvantages.

It is another object of the present invention to provide a new and improved dessert cup holder which may be easily and efficiently manufactured and marketed.

It is a further object of the present invention to provide a new and improved dessert cup holder which is of durable and reliable constructions.

An even further object of the present invention is to provide a new and improved dessert cup holder which is susceptible of a low cost of manufacture with regard to both materials and labor, and which accordingly is then susceptible of low prices of sale to the consuming public, thereby making such dessert cup holder economically available to the buying public.

Even still another object of the present invention is to provide a dessert cup holder for releasably receiving and supporting a small dessert cup on a larger holder base to facilitate handling by those with reduced motor skills such as younger children, elderly senior citizens and physically retarted people, the system being safe, convenient and economical.

Lastly, it is an object of the present invention to provide a new and improved dessert cup holder. A rigid support base has flat parallel top and bottom surfaces. The top and bottom surfaces are separated by a thickness. The support base has a plurality of holes. A plurality of rigid rods is provided. Each rod has a lower end. The lower end is received and retained within an associated hole. Each rod has a notch. Each notch includes an upper ledge. The upper ledge is provided parallel with the top surface of the support base. Each notch includes an angled lower ledge. The lower ledge depends from an associated upper ledge.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a perspective illustration of a dessert cup holder system adapted to removably receive a dessert cup, the system constructed in accordance with the principles of the present invention.

FIG. 2 is a cross sectional view of the system taken along line 2-2 of FIG. 1.

The same reference numerals refer to the same parts throughout the various Figures.

DESCRIPTION OF THE PREFERRED EMBODIMENT

Figure 4:
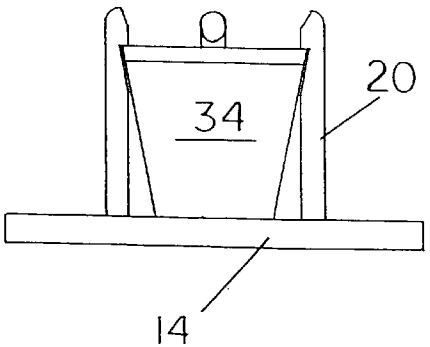
FIG. 4 is a side elevational view of the system with the cup coupled in place but with one rod removed.

With reference now to the drawings, and in particular to FIG. 1 thereof, the preferred embodiment of the new and improved dessert cup holder embodying the principles and concepts of the present invention and generally designated by the reference numeral 10 will be described.

The present invention, the dessert cup holder 10 is comprised of a plurality of components. Such components in their broadest context include a rigid support base and a plurality of rigid rods. Such components are individually configured and correlated with respect to each other so as to attain the desired objective.

First provided is a support base 14. The support base is provided in a rectangular configuration. The support base has parallel upper and lower edges. The upper and lower edges are separated by a height of between 4 and 8 inches. The support base has parallel side edges. The side edges are separated by a width of between 8 and 12 inches. The support base has flat parallel top and bottom surfaces. The top and bottom surfaces are separated by a thickness of between 0.50 and 0.75 inch. The support base is fabricated of a rigid plastic material. Alternate materials for the support base include wood and metal. The support base has four cylindrical holes 16. The holes are in a rectangular configuration between 2.1 and 2.2 inches a side. The holes include two vertical holes. The vertical holes are aligned with the side edges. The vertical holes are equally spaced from the upper and lower edges. The vertical holes are equally spaced from the side edges. The holes include two horizontal holes. The horizontal holes are aligned with the upper and lower edges. The horizontal holes are equally spaced from the side edges. The horizontal holes are equally spaced from the upper and lower edges.

Four essentially cylindrical rods 20 are provided. Each rod has a diameter of between 0.125 and 0.375 inch. Each rod has a lower end 22. The lower end is received and retained frictionally and adhesively within an associated hole. Each rod has an upper end 24. The upper end is located between 2.50 and 2.75 inches above the top surface of the support base. Each of the rods are fabricated of a rigid plastic material. Alternate materials for the rods include wood and metal. Each rod is has a notch 26. The notch of each rod faces the notch of a non-adjacent rod. Each notch includes an upper ledge 28. The upper ledge is provided parallel with the top surface of the support base. Each upper ledge is spaced from the top surface of the support base by between 2.125 and 2.375 inches. Each upper ledge has a depth equal to between 40 and 60 percent of the diameter of the rods. Each notch includes an angled lower ledge 30. The lower ledge depends from an associated upper ledge. The lower ledge extends downwardly to a distance between 1.50 and 1.75 inches from the top surface of the support base.

Figure 3:
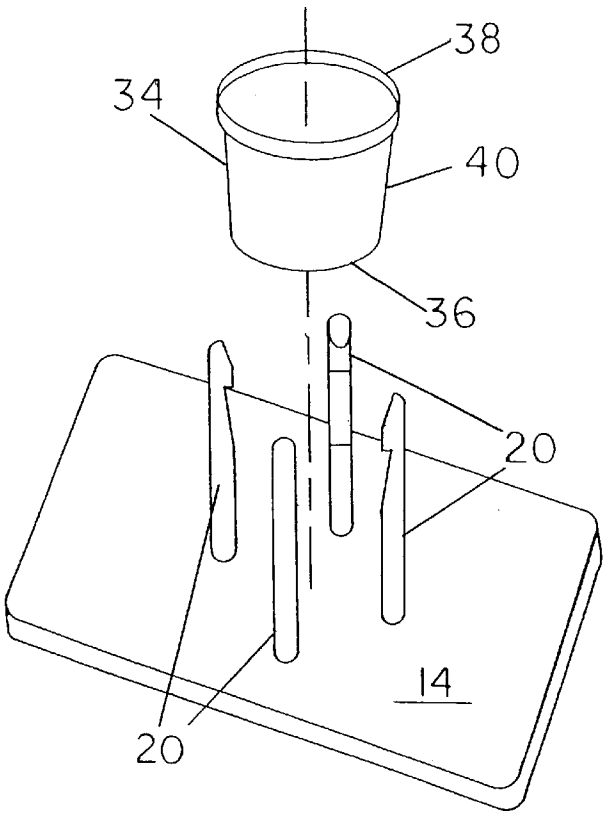
FIG. 3 is an exploded perspective illustration of the system with the cup in a spaced elevated orientation prior to coupling.

As may be readily seen in FIGS. 1 and 3, the upper ledge and the lower ledge of each rod are joined at a linear joining line with opposed ends at laterally spaced points on the exterior surface of the rod. The upper ledge is bounded by the joining line.

Provided last is a dessert cup 34. The dessert cup has a closed circular bottom 36. The dessert cup has an open circular top 38. The dessert cup has a frusto-conical side wall 40. The bottom has a diameter of between 2.125 and 2.375 inches. The top has a diameter of between 2.875 and 3.125 inches. The dessert cup is fabricated of generally rigid material with limited flexibility. Alternate materials for the dessert cup include paper and foamed plastic. In this manner the desert cup is adapted to be moved between a supported orientation and an unsupported orientation. The unsupported orientation is with the cup separated from the support base. The supported orientation is with the bottom of the dessert cup positioned on the top surface of the support base. The top of the dessert cup is secured beneath and in contact with the upper ledges and laterally offset from the angled ledges of the rods. The dessert cup is movable between the supported orientation and the unsupported orientation through the flexing of the top of the dessert cup.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A cup and holder system comprising:

a rigid support base having horizontal flat top and horizontal flat bottom surfaces separated by a thickness, the support base having a plurality of holes;

a plurality of rigid rods, each rod having a cylindrical exterior surface, each rod having a lower end received and retained within an associated hole, each rod being shaped with a notch, each notch including a flat upper ledge parallel with the top surface of the support base, each notch including an angled flat lower ledge depending from an associated upper flat ledge, the upper ledge and the lower ledge of each rod being joined at a joining line with opposed ends at laterally spaced points on the exterior surface of the rod, the upper ledge being bounded by the joining line and a continuous upper line in the exterior surface of the rod; and a cup formed with a closed bottom and an open top and a generally frusto-conical side wall, the cup having a radially extending portion, the bottom of the cup removably received on the support base with the radially extending portion of the cup in contact with the horizontal flat upper ledges of the notches and with the radially extending portion of the cup in contact with the angled depending flat lower ledges of the notches, the cup being fabricated of generally rigid material with limited flexibility whereby the cup is adapted to be flexed for movement to a location separated from the support base and the rods.

2. A dessert cup holder (10) for releasably receiving and supporting a small dessert cup on a larger holder base to facilitate handling by those with reduced motor skills such as younger children, elderly senior citizens and physically handicapped people, the system being safe, convenient and economical, the system comprising, in combination:

a support base (14) in a rectangular configuration having parallel upper and lower ledges separated by a height of between 4 and 8 inches, the support base having parallel side ledges separated by a width of between 8 and 12 inches, the support base having flat parallel top and bottom surfaces separated by a thickness of between 0.50 and 0.75 inch, the support base being fabricated of a rigid plastic material, the support base having four cylindrical holes (16) in a rectangular configuration between 2.1 and 2.2 inches a side;

four essentially cylindrical rods (20), each rod having an exterior surface with a circular cross sectional configuration, each rod having a diameter of between 0.125 and 0.375 inch, each rod having a lower end (22) received and retained frictionally and adhesively within an associated hole, each rod having an upper end (24) located between 2.50 and 2.75 inches above the top surface of the support base, each of the rods being fabricated of a rigid plastic material, each rod being shaped with a notch (26), the notch of each rod facing the notch of a non-adjacent rod, each notch including an upper ledge (28) parallel with the top surface of the support base, each upper ledge being spaced from the top surface of the support base by between 2.125 and 2.375 inches, each upper ledge having a depth equal to between 40 and 60 percent of the diameter of the rods, each notch including an angled lower ledge (30) depending from an associated upper ledge and extending downwardly to a distance between 1.50 and 1.75 inches from the top surface of the support base, the upper ledge and the lower ledge of each rod being joined at a joining line with opposed ends at laterally spaced points on the exterior surface of the rod, the upper ledge being bounded by the joining line and a continuous upper line in the exterior surface of the rod; and a dessert cup (34) with a closed circular bottom (36) and an open circular top (38) and a frusto-conical side wall (40), the bottom having a diameter of between 2.125 and 2.375 inches, the top having a diameter of between 2.875 and 3.125 inches, the dessert cup being fabricated of generally rigid material with limited flexibility whereby the desert cup is adapted to be moved between a supported orientation and an unsupported orientation, the unsupported orientation being with the cup separated from the support base, the supported orientation being with the bottom of the dessert cup positioned on the top surface of the support base and with the top of the dessert cup secured beneath and in contact with the upper ledges and laterally offset from and in contact with the angled ledges of the rods, the dessert cup being movable between the supported orientation and the unsupported orientation through the flexing of the top of the dessert cup.

* * * * *